United States Patent [19]

Chan et al.

[11] 4,104,713

[45] Aug. 1, 1978

[54] HEAT DISSIPATING LIGHTING FIXTURE MOUNT

[75] Inventors: Kingsley Chan, Rutherford; Mahendra K. Patel, Carteret; Sidney Wolkin, Rahway, all of N.J.

[73] Assignee: Lightolier Incorporated, Jersey City, N.J.

[21] Appl. No.: 792,722

[22] Filed: May 2, 1977

[51] Int. Cl.[2] ..... F21V 29/00

[52] U.S. Cl. ..... 362/294; 362/373

[58] Field of Search ..... 362/294, 373, 404, 382, 362/418, 429, 430

[56] References Cited

U.S. PATENT DOCUMENTS

| | | | |
|---|---|---|---|
| 2,638,531 | 5/1953 | Levy | 362/373 X |
| 3,459,934 | 8/1969 | Moore | 362/294 |
| 4,044,246 | 8/1977 | Domico et al. | 362/294 |

*Primary Examiner*—Richard L. Moses
*Attorney, Agent, or Firm*—Arthur B. Colvin

[57] ABSTRACT

The present invention is directed to a lighting fixture mount, and more particularly to a heat dissipating or distributing lighting fixture mount which minimizes the transfer of heat generated by an incandescent bulb or the like in the fixture to the junction box providing the electrical power therefor, and most particularly to the screws which fasten the fixture to the junction box and consequently are exposed within the box to possible contact with the insulation of wires within the box. By preventing overheating of the support screws, the possibility of damaging the insulation and creating a short circuit is minimized.

6 Claims, 4 Drawing Figures

HEAT DISSIPATING LIGHTING FIXTURE MOUNT

BACKGROUND OF THE INVENTION

1. Field of the Invention

The present invention is in the field of lighting fixtures, and more particularly pertains to a mounting apparatus for lighting fixtures, such as ceiling fixtures, whereby the transfer of heat to the junction box from which power is drawn, and particularly to the screws securing the fixture to the junction box is minimized.

2. The Prior Art

Numerous efforts have beem made to provide a lighting fixture having safety features whereby the heat generated in the fixture would be prevented from causing deterioration of insulation on the wires powering the fixture. Mention may be made of U.S. Pat. Nos. 1,667,961; 1,885,514; 2,515,390; 2,638,531; and 2,943,137 as showing fixtures having features pertinent to the field of the present invention. While certain of the above referenced patents propose solutions of the heat transfer problem, none has provided a satisfactory degree of thermal isolation especially of the screws which connect the fixture to the junction box without drastically reducing installation flexibility and increasing the complexity and, hence, the cost of lighting fixtures.

SUMMARY OF THE INVENTION

The present invention may be summarized as directed to an improvement in lighting fixture design, and more particularly to an improved mounting mechanism for a fixture, such as a lighting fixture which, by virtue of its support of an incandescent lamp or the like, may generate excessive heat. Still more particularly, the invention pertains to a lighting fixture and mounting means therefor whereby a minimum of heat is transferred to the junction box powering the fixture or the screws connecting the fixture to the box.

The fixture incorporates an annular mounting ring assembly having a cross bar adapted to be connected by screws to the conventional support means of the junction box and having, in addition, a support bracket rotatably mounted relative to the ring, the bracket including minimal conductive contact points with the ring. The bracket, in turn, incorporates means for supporting the top plate of an electrical fixture carrying a light bulb socket whereby there is defined between the socket and the junction box an elongate thermal conductivity path to reduce the heat conducted by the incandescent bulb to the junction box.

It is accordingly an object of the invention to provide an improved lighting fixture.

A further object of the invention is the provision of a lighting fixture of the low heat transfer type which is simple, practical, compact in construction, strong and reliable in use, and relatively inexpensive to manufacture.

A still further object of the invention is the provision of a fixture of the type described and of a mounting means or element thereof which can easily be applied to or removed from mounted position and which may readily be adjusted for the support of fixtures of various shapes.

Still a further object of the invention is the provision of a device of the type described which permits of a maximum degree of adjustment of the position of the fixture relative to the ceiling or like surface adjacent which the fixture is mounted, providing a maximum degree of flexibility in use.

Still a further object of the invention is the provision of a fixture of the type described wherein an elongated thermal conductivity path is interposed between the housing for the light bulb and the junction box providing power to the fixture.

In the accompanying drawings in which are illustratively shown various embodiments of the several features of the invention;

Figure 1:
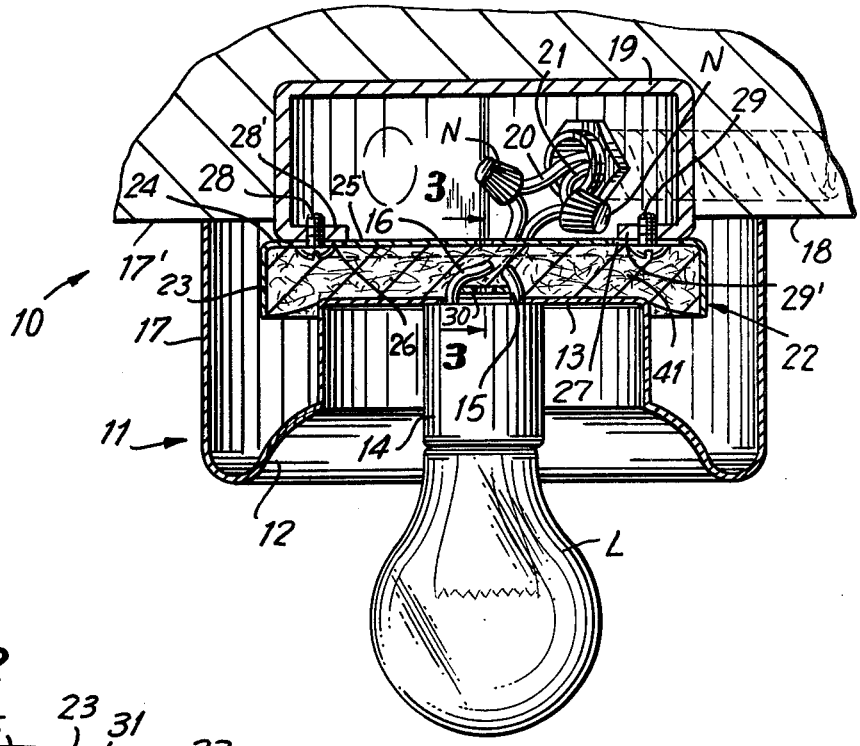
FIG. 1 is a vertical sectional view through a lighting fixture in accordance with the invention.

Turning now to the drawings, there is shown in FIG. 1 a lighting fixture 10 which includes a housing 11 having a reflector surface 12, it being understood that, as is conventional in devices of this sort, a diffuser or shade (not shown) may be suitably mounted on the housing.

The housing 11 includes a top plate 13, to which a conventional bulb socket 14 is mounted by any suitable means, the socket 14 incorporating the usual conductors 15, 16 which are led to the mains supply. The housing 11 may include a skirt 17 which, in the mounted position, abuts the ceiling 18. A conventional junction box 19 is mounted above the ceiling, the box providing access to mains conduits 20, 21.

Figure 2:
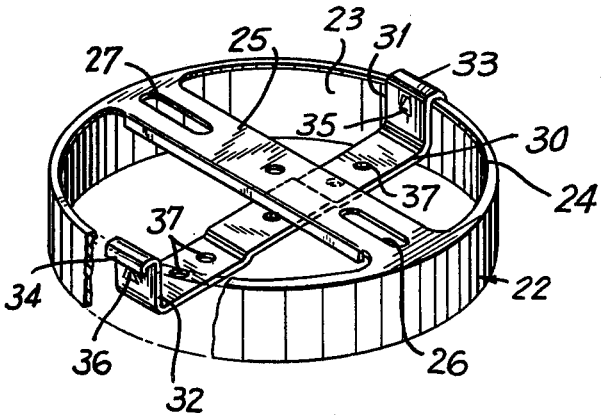
FIG. 2 is a top perspective view of the mounting ring element thereof, with the thermal insulation material removed therefrom for purposes of clarity of illustration.

Interposed between the housing 11 and the junction box 19 is a mounting ring assembly 22, as shown in FIG. 2. The mounting ring assembly 22 comprises an annular body portion 23 having at its upper edge an inturned annular rim 24. An integral mounting bar 25 extends diametrically across the ring 22, the bar being provided with mounting slots 26, 27 which are preferably elongated and adapted to register with the mounting screws 28, 29 of the junction box.

The mounting ring assembly 22 includes a mounting bracket 30 which extends diametrically across the mounting ring and is rotatable relative thereof throughout a substantial arcuate path. The bracket 30 is fixed to the ring 22 by a pair of mounting legs 31, 32, the legs having upper support shoulders 33, 34, respectively, overlapping the inturned rim portion 24.

Figure 3:
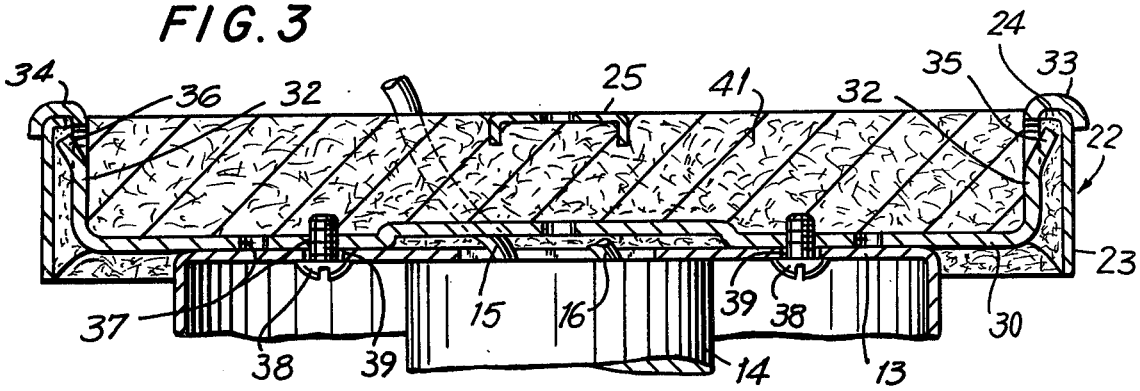
FIG. 3 is a magnified vertical section taken on the line 3—3 of FIG. 1.

The legs are locked to the ring by outwardly deflected locking tabs 35, 36, respectively, which, after positioning of the shoulders are deflected radially outwardly so as to underlie the rim 24 (see FIG. 3).

It will be recognized from a consideration of FIGS. 2 and 3 that the above described arrangement will permit the bracket 30 to be rotated or angularly moved through an arc which, in practice, is somewhat less than 180°, the extent of relative angular movement between the track and ring being limited by contact between legs 31, 32 and the lateral side portions of the bar 25.

As best seen in FIG. 1, a circular thermal insulation pad 41 is introduced into the area between the bar 25 and the bracket 30, the pad being maintained in position by the said bracket and bar.

As best seen in FIG. 3, the legs 31, 32 are disposed in spaced relation to the inner surface of the ring 22, contact between the noted parts being limited substantially to the areas of engagement at the upper end of said legs.

In practice, the device is mounted by connecting the leads 15, 16 from the fixture to the mains leads 21, 20, respectively, the connection being secured and protected in the usual manner by wire nuts N.

Preferably the leads 15, 16 are passed through the mass of insulation, although this is not mandatory. Next, the bar 25 is mounted to the junction box 19 by passing the machine screws 28, 29 upwardly through the slots 26, 27, whereafter, by tightening of the screws, the bar, and hence the ring assembly 22, is locked into position on the junction box. By virtue of the elongated nature of the slots 26, 27, a degree of lateral adjustability between the ring assembly and the junction box is permitted.

With the ring positioned as noted, the housing 11 is secured to the bracket 30. For this purpose the bracket is provided with a plurality of tapped apertures 37 longitudinally spaced along the bracket. Machine screws 38 are passed upwardly through apertures 39 in the top wall 13 of the housing and into the noted tapped apertures 37 to effect connection between the top wall and the bracket.

As is conventional, the apertures 39 in the top wall portion 13 may be of the so-called "key hole" type which includes an enlarged entrance portion communicating with a relatively restricted locking portion, whereby the housing may be mounted without removal of the screws 38 merely by loosening the screws, introducing the heads of the screws through the widened entrance ways, and thereafter partially rotating the housing to bring the narrowed portions of the apertures 39 into a position beneath the heads of the machine screws 38.

Prior to final tightening of the machine screws 38, the fixture may be rotated relative to the ceiling, such rotary movement being permitted by the movable connection afforded between the bracket 30 and the ring assembly 22.

It will be further understood that if the junction box has been properly installed heightwise relative to the ceiling, the tightening of the machine screws 38 will cause the end portion or perimeter 17' of the skirt 17 to bear against the ceiling 18, the length of the screws 38 providing a degree of adjustment in the event of a heightwise misinstallation of the junction box.

With the fixture thus positioned and a bulb L installed, it will be readily recognized that the heat generated by the bulb will be transferred principally upwardly to the support mechanism. Desirably, the amount of heat transferred to the junction box is kept to a minimum. In the instant device such minimum heat transfer is assured by the provision of a relatively long thermal path, coupled with minimum contact areas between the housing 11 and the junction box 19.

Specifically, heat generated by the bulb is transferred principally to the bracket member 30. Thereafter, the heat is conducted along the bracket member and into the ring 22. In order for the heat introduced into the ring assembly 22 to be transferred to the junction box 19, it must pass around the ring and into the transversely extending bar 25, whereafter it will be conducted to the screws 28, 29 and screw receiver tabs 28' and 29' within which the screws are supported.

It will thus be recognized that by the provision of an elongated path, heat transfer is minimized.

Figure 4:
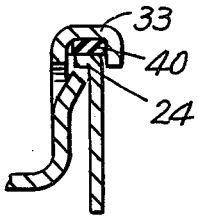
FIG. 4 is a fragmentary sectional view through an embodiment of the invention.

A further factor minimizing heat transfer to the junction box lies in the relatively limited contact areas between the bracket 30 and ring assembly 22.

Where the desirable feature of having the housing 11 grounded is not required due to the fact that the housing 11 is of non-electrically conductive material, such as plastic, an annular insulator washer 40 may be disposed over the top of the rim 24 (see FIG. 4) even further to minimize heat transfer from the bracket to the ring assembly since the support shoulders 33, 34 then engage against such insulated material, defining a thermal break. In such construction there is virtually no metal-to-metal contact between the bracket and the ring since the locking tabs 35, 36 normally hang clear of the rim.

The presence of the insulated mass 41 acts still further to reduce heat transfer to the junction box.

Importantly, the described arrangement minimizes heat transfer through the shanks of screws 38 which enter into the junction box and hence constitute the component contacting the fixture most likely also to contact wires in the junction box.

From the foregoing it will be recognized that there is defined in accordance with the invention a lighting fixture of simple design, incorporating a mounting ring assembly interposed between the bulb housing and the junction box, which ring assembly permits a great deal of flexibility and adjustability in mounting and enables a rigid assembly of the parts while at the same time minimizing heat transfer from the housing to the junction box.

An important factor in such minimization of heat transfer resides in the ability relatively to rotate the bracket 30 connected to the housing and the cross bar 25 connected to the junction box, such that the two noted partes are offset at a maximum angle (90° being optimum) whereby the thermal condctivity path across the ring assembly and to the connector screws 38 is elongated to the greatest possible extent.

The fixture is inexpensive to manufacture, simple to install, strong and reliable, and by virtue of the cross bar arrangement facilitates the retention of an insulator between the bar and the bracket.

As will be obvious in the light of the instant disclosure, numerous variations may be made in specific details of construction without departing from the spirit of the invention.

Accordingly, the invention is to be broadly construed within the scope of the appended claims.

Having thus described the invention and illustrated its use, what is claimed as new and is desired to be secured by Letters Patent is:

1. A heat dissipating lighting fixture adapted to be mounted to a junction box having spaced mounting screws extending into said box comprising, in combination, a housing including a top plate member, a light socket mounted on said plate member, a mounting ring assembly adapted to connect said housing to said junction box, said ring assembly including a horizontally directed annular rim, a mounting bar at the upper edge of said ring assembly, said bar including spaced elongate aperture means for receiving said mounting screws of said junction box to hold said bar to said box, a housing support bracket movably mounted to said ring assembly, said bracket extending diammetrically of said ring assembly in parallel spaced relation to said bar, said bracket including at each of its longitudinal extremities means releasably and rotatively to support said bracket with respect to said ring assembly, whereby said bracket may be rotated relative to said ring assembly but is locked against substantial movement in directions normal to the plane of said rim, heat insulation means disposed in said ring assembly between said bracket and said bar and fastener means on said bracket adapted to be received in complemental fastener means on said top plate of said housing, whereby said bracket is clampingly engaged against said top plate, said assembly providing an elongate heat conducting path from said housing to said junction box, said path extending through said bracket to said rim and from said rim to said bar.

2. A fixture in accordance with claim 1 in which said housing is of electrically conductive material and said housing support bracket is electrically connected to said housing and to said mounting ring assembly.

3. A fixture in accordance with claim 1 in which said means releasably and rotatively to support said bracket comprises an upwardly directed leg portion at each of the longitudinal extremities of said bracket and disposed adjacent and spaced from the inner surface of said ring assembly, each of said leg portions including at its upper end a support shoulder overlying said rim and a locking tab underlying said rim.

4. A fixture in accordance with claim 3 in which said housing is of non-electrically conductive material and in which an annular insulator washer is disposed above said rim and interposed between said rim and said support shoulders.

5. A fixture in accordance with claim 1 wherein said bracket and said mounting bar are disposed at right angles to each other thereby to define the longest available heat conductor path to said junction box.

6. A fixture in accordance with claim 1 and including electrical conduit means extending from said socket through said insulation means.

* * * * *